United States Patent [19]

Vander Wall

[11] 4,246,712

[45] Jan. 27, 1981

[54] PIPE IDENTIFICATION SYSTEM

[76] Inventor: James A. Vander Wall, 5579 Lake Harbor Rd., Muskegon, Mich. 49441

[21] Appl. No.: 36,181

[22] Filed: May 4, 1979

[51] Int. Cl.[3] ..... G09F 3/14

[52] U.S. Cl. ..... 40/316; 40/2 R; 40/21 R

[58] Field of Search ..... 40/316, 21 R, 21 B, 40/20 R, 20 A, 10 A, 2 R, 612, 607

[56] References Cited

U.S. PATENT DOCUMENTS

| | | | |
|---|---|---|---|
| 1,291,206 | 1/1919 | Simpson | 40/316 |
| 1,486,850 | 3/1924 | Avery et al. | 40/10 B |
| 1,960,748 | 5/1934 | Meunier | 40/21 R |
| 2,109,921 | 3/1938 | Leach | 40/582 X |
| 2,175,260 | 10/1939 | Gollwitzer | 101/369 |
| 2,617,215 | 11/1952 | Morris | 40/2 R |
| 3,340,630 | 9/1967 | Becker | 40/21 C |
| 3,486,257 | 12/1969 | Walldorf | 40/2 R |
| 3,491,470 | 1/1970 | Geisinger | 40/10 R |
| 3,556,291 | 1/1971 | Sebring | 40/21 R |
| 3,983,603 | 10/1976 | Joyce | 24/16 PB |
| 4,033,057 | 7/1977 | Jaffe | 40/21 R |
| 4,176,484 | 12/1979 | Terris | 40/584 |

OTHER PUBLICATIONS

Band-It Brack-Its, Brochure, 4-1966, p. 14.

Brady Catalog FIP-3, pp. 1,5-9, Facilities Identification Products Division.

*Primary Examiner*—John F. Pitrelli

*Attorney, Agent, or Firm*—Price, Heneveld, Huizenga & Cooper

[57] ABSTRACT

A pipe identification system includes a marker fabricated from a rigid material and having indicia imprinted thereon providing information on the pipe contents. Flow direction markers are removably secured and integral with opposite ends of the contents marker. Each flow direction marker has indicia thereon indicating flow direction. One or both of the flow direction markers may be separated from the contents marker prior to attachment of the marker to a pipe. One or more straps engage the markers for attaching the markers to a pipe.

10 Claims, 6 Drawing Figures

PIPE IDENTIFICATION SYSTEM

BACKGROUND OF THE INVENTION

The present invention relates to identification systems and more particularly to devices for indicating the contents and flow direction of a piping system.

In the chemical industry and in power plants, for example, it is highly desirable to mark pipes, conduits and the like to indicate contents, flow direction and other information. The marking of relatively complex piping systems with such information can prevent injury. This is especially true in emergency situations which might involve outside fire departments whose personnel would not be familiar with the piping system. Proper identification also effectively increases efficiency of a facility's operation. Lost time spent tracing piping systems or reviewing blueprints is not required to determine pipe contents, flow direction and the nature of the fluid contained therein.

ANSI 13.1 1956 (as revised 1975) is a standard entitled "Scheme for the Identification of Piping Systems". This standard was developed to promote safety by standardizing color coding, size of indicia and other piping system identification markings. The standard includes marking of pipes with a specific color which would indicate whether or not the fluid contained therein is hazardous, gaseous, liquid, low hazard or a fire quenching material. By so marking the pipes, critical information is obtained merely by visual inspection.

Various proposals have theretofore been made to meet the requirements of the standard. One such proposal involves painting the piping systems with the appropriate color, lettering to indicate contents and painting on flow direction indicia. This approach is costly, inefficient, time consuming and therefore not acceptable. Further, with a large number of piping systems high maintenance requirements would result from painting and/or the paint would not properly stick to the piping systems if they are excessively rusted or greasy.

In an attempt to overcome the problems associated with merely painting the systems to provide the required information, various other proposals have been made. One such proposal involves providing a pressure sensitive adhesive tape having the appropriate indicia thereon. Due to the different types of piping systems involved and their environments, this approach necessitates different forms of tape material and adhesives. For example, if the piping system is hot, a tape material having high temperature characteristics is required as well as a different adhesive. Problems are experienced with insuring that the adhesive tape sticks to the pipe. If the pipe is covered with insulation, is rusted and/or is excessively dirty or greasy, the tape systems may not be completely acceptable.

In an attempt to overcome these problems, prior proposals have included the providing of a rigid carrier or support which is affixed to the pipe. The proper indicia is then carried by the holder or carrier. In one example, a plastic plate is secured to the pipe by bands or straps and the indicia carrying adhesive tape is then affixed to the plate. The plate therefore provides a clean surface to insure proper application of the tape material. Other examples of this approach may be found in U.S. Pat. No. 1,960,748, entitled IDENTIFICATION OF PIPING SYSTEMS and issued on Mar. 29, 1934 to Meunier and U.S. Pat. No. 4,033,057, entitled MARKING TAPES FOR MARKING ARTICLES and issued on July 5, 1977 to Jaffe. The system disclosed in the Jaffe patent includes a tubular hose or cover of transparent material within which a separate marking plate is disposed. The hose acts as a carrier and it is affixed to the pipe.

The prior proposals have not fully solved the problems of pipe system identification. The prior proposals by their vary nature have been costly or inefficient, bulky, time consuming to apply and/or not universally adaptable to the various pipes and environments encountered.

SUMMARY OF THE INVENTION

In accordance with the present invention, a unique identification system for pipe, conduit and the like is provided whereby the problems heretofore experienced are substantially alleviated. The system in accordance with the present invention and components thereof are adapted to readily indicate contents, nature of the contents and flow direction, as well as other information, with a reduction in the number of elements or components, an increase in the ease of manufacture and complete adaptability to the various piping systems and environments encountered. Essentially, the system includes a marker defined by an elongated body of rigid material and having a central portion and at least one integral, removable end plate or end portion frangibly connected to the central portion. The body has appropriate identifying indicia or information imprinted thereon.

In narrower asepcts of the invention, a removable end portion is defined at each end of the central portion. Contents information is printed on the central portion and flow direction information is printed on the end portions. The flow indicating indicia are in the form of arrows which are oppositely directed. As a result, the marker is adapted for use with any pipe which may be encountered and either direction of flow may be selected. Once the contents and flow direction are determined, one of the markers may be separated from the central portion and the central portion and the remaining flow direction portion are affixed to the pipe. The removed portion may then be strapped to the pipe at a point downstream of or upstream of the contents information. The marker may be attached to the pipe with flexible self-locking straps or metal tie bands. The system is easily and readily manufactured by a simple stamping process. Packing, shipping and use are simplified since each marker may be useable to indicate flow in either direction and separate markers indicating flow and/or contents need not be packed and shipped.

DETAILED DESCRIPTION OF THE PREFERRED EMBODIMENT

Figure 1:
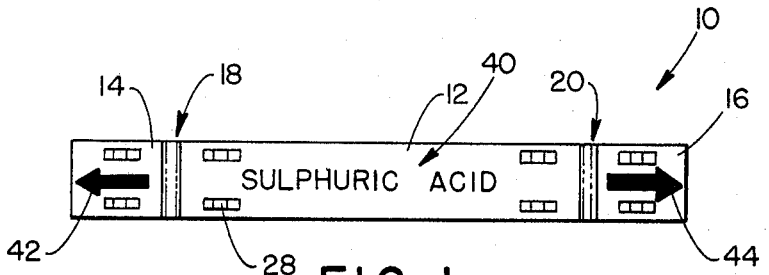
FIG. 1 is a front, plan view of a pipe identification device in accordance with the present invention.
Figure 2:
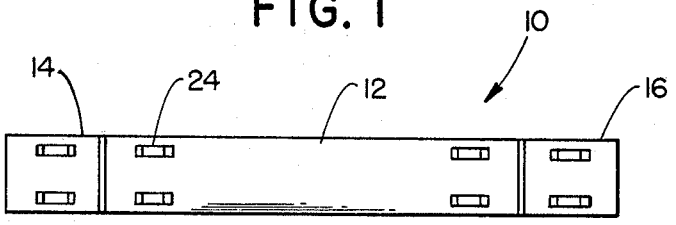
FIG. 2 is a rear, plan view thereof.
Figure 3:
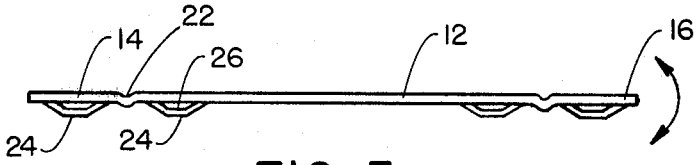
FIG. 3 is a side, elevational view thereof.

The peferred embodiment of an identification marker in accordance with the present invention for identifying the contents of a pipe, conduit and the like is illustrated in FIGS. 1, 2 and 3 and generally designated 10. As shown therein, marker 10 comprises an elongated body of rigid material having a central, elongated portion 12 and end portions 14, 16. The end portions 14, 16 are frangibly connected to the central portion along lines 18 and 20 respectively. In the form illustrated, the lines 18, 20 are defined by elongated grooves 22 which open up through the front surface of the marker. As a result, end portions 14, 16 are integrally connected to central portion 12. The marker 10 is fabricated from a rigid breakable material such as aluminum or a rigid plastic. In order to separate one of the end portions 14, 16 from the central portion 12, the end portion is merely bent along the lines 18, 20 until the elastic limit of the material is reached and the end portion breaks away from central portion 12. In the alternative, the end portions could be frangibly connected to central portion 12 by lines of weakness, such as perforations, score lines or by a line of reduced thickness. When the marker is fabricated from a metal such as aluminum, the grooves or frangible connections are easily and readily formed during a simple stamping operation.

In the preferred form, central portion 12 and end portions 14, 16 are fabricated with integral, transversely spaced offset straps 24. The offset straps are formed by a simple double lance step during a stamping operation. As a result, each of the offset straps define a passage 26 and further overly apertures 28 which open through the front and back surfaces of central portion 12 and end portions 14, 16.

Figure 4:
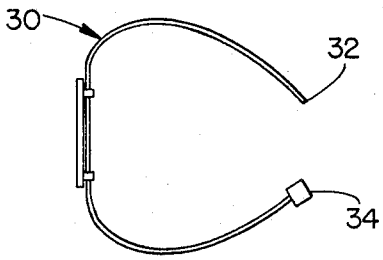
FIG. 4 is an end, elevational view of the marker including an attachment means.

As best seen in FIG. 4, the offset straps are dimensioned to receive through passage 26 an attachment strap generally designated 30. Attachment straps 30 are generally flexible, elongated members having an end 32 insertable through a locking member 34. The straps, as discussed below, are employed to secure the marker 10 to a pipe, conduit or the like. The straps are readily available, commercial items. One form of strap useable with the present invention is illustrated in U.S. Pat. No. 3,983,603, entitled TIE FOR BUNDLING ITEMS and issued on Oct. 15, 1976 to Joyce. To the extent necessary, the disclosure of this patent is incoporated by reference. In the alternative, metal bands or other forms of straps could be used to attach the marker to a pipeline.

As best seen in FIG. 1, central portion 12 has imprinted thereon indicia indicating the contents of the piping systems or providing other information. For example, indicia 40, as illustrated in FIG. 1, states the contents of the piping system to be sulfuric acid. In addition, the marker body may be painted in accordance with the color coding standardized in ANSI A 13.1 1956 (as revised 1975) and entitled "Scheme for the Identification of Piping Systems". End portions 14, 16 include flow direction indicating indicia 42, 44 in the form of flow direction arrows. As seen in FIG. 1, the flow direction arrows 42, 44 are oppositely directed. The markers 10 are preferably fabricated in a plurality of different sizes in accordance with the aforementioned ANSI standard. The markers and pipe identification system in accordance with the present invention may, therefore, be employed to indicate pipe contents and other information indicating the nature of the contents, that is, whether the contents are hazardous, low hazard, gaseous, liquid or fire quenching materials.

Figure 6:
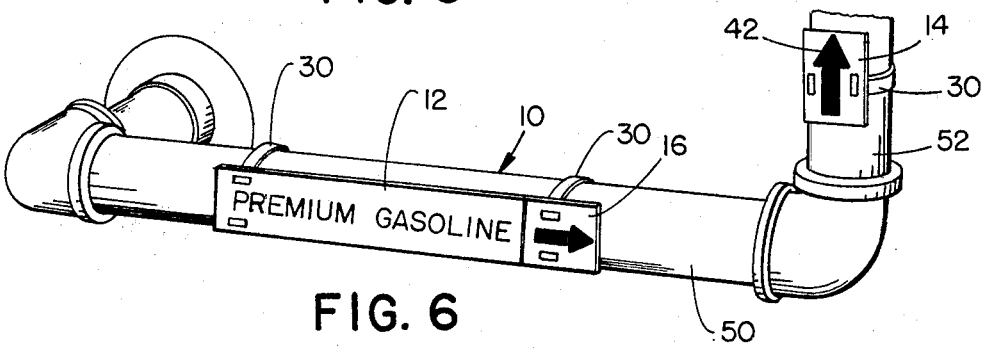
FIG. 6 is a perspective view showing the pipe identification marker attached to a pipe.

The marker 10 is provided with two oppositely directed arrows so that flow direction in either direction can be selected and indicated by the marker 10. Once the user determines the direction of flow in the piping system, the end portion 14 or 16 which is not required may be simply broken away due to the frangible interconnection. The contents marker including the central portion 12 and the remaining end portion is then affixed to a piping system employing the straps 30. This is illustrated in FIG. 6. As shown therein, a marker 10 includes the contents identifying indicia "premium gasoline" imprinted thereon. The flow direction in the piping system is to the right when viewed in the figure and end portion 14 of the marker has been broken away from central portion 12. Central portion 12 and end portion 16 are then affixed to the pipe 50 by flexible straps 30 extending between the offset straps 24 and the marker body. The removable end portion 14 containing the flow direction indicating arrow 42 is shown in FIG. 6 affixed to another pipe section 52 downstream of the contents indicating portion 12 of the marker. End portion 14 is easily and readily affixed to the pipe employing the simple flexible tie strap 30.

The pipe identification system in accordance with the present invention including the marker 10 having the frangible end portions 14, 16 and the attachment means 30 permits quick application and identification of piping systems. The double arrow "break away" feature permits either direction of flow to be indicated employing a single marker. The removed marker portion is then easily and readily attachable either downstream or upstream of the main marker portion to thereby indicate direction of flow at another point in the pipe line. Also, the marker readily indicates when two-way flow is present.

The attaching means or straps 30 are easily slipped through the offset strap portions 24 and readily secure the markers to the pipe line in a permanent or semi-permanent fashion. Problems heretofore experienced with the application of tape identification systems are eliminated. The identifying indicia 40 and flow directing indicia 42, 44 are readily placed or imprinted directly on the marker body during the manufacturing process. The present invention represents a significant improvment in efficiency of use and possesses a decreased cost of manufacture when compared to prior systems emplying separate carriers and separate marking plates. The same system may be employed with a full range of pipe systems and environments encountered without the need for special materials and/or adhesives.

Figure 5:
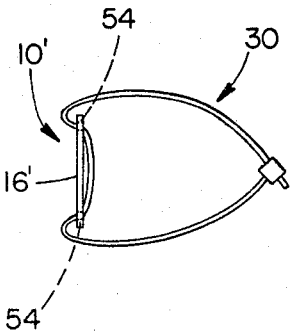
FIG. 5 is an end, elevational view of an alternative embodiment in accordance with the present invention.

An alternative embodiment is illustrated in FIG. 5 and generally designated 10'. Alternative embodiment 10' is similarly fabricated from a rigid material. Embodiment 10' includes a central portion and frangible end portions with end portion 16' shown in FIG. 5. Embodiment 10' differs from embodiment 10 in that the offset strap portions are not employed. In this embodiment, the central portion end portions are stamped with through slots 54. An attachment strap 30 is threaded through the slots 54 along the back surface of the marker. Embodiment 10' may not be as easy to use as the preferred embodiment 10. If the attachment straps 30 are relatively rigid, additional time is required to thread them through the open slots 54 than is necessary to merely slide the strap between the strap portions 24 in the back surface of the marker 10. Embodiment 10' does, however, illustrate an alternative method for securing the attachment means to the marker and hence to a pipe line.

In view of the foregoing description, it should now be readily apparent to those of ordinary skill in the art that the pipe identification system in accordance with the present invention is easily and readily manufactured from available materials by simple stamping processes. If the markers are fabricated from plastic, simple molding processes may be employed. Pacing, shipping and use of the system are simplified when compared to the prior proposals since each marker may be useable to indicate flow in either direction and separate markers or tapes or carriers indicating flow and/or contents need not be employed. The present invention is, therefore, extremely versatile and posseses significant advantages over the prior structures.

It is expressly intended, however, that the above description should be considered only as that of the preferred embodiment. Various modifications will undoubtedly now become apparent to those of ordinary skill in the art which would not depart from the inventive concepts disclosed herein. For example, information other than contents information could be imprinted on the marker body. Also, as set forth above, a frangible interconnection other than the groove structure illustrated could be employed depending upon the material from which the marker is fabricated. The true spirit and scope of the present invention, therefore, may be determined by reference to the appended claims.

The embodiments of the invention in which an exclusive property or privilege is claimed are defined as follows.

1. A marker for identifying the contents of pipe, conduit and the like, comprising:

an elongated body of rigid material having a central portion and a pair of integral, removable end portions frangibly connected to said central portion at longitudinal ends thereof, said central portion having identifying indicia imprinted thereon and said end portions having oppositely directed flow identifying indicia imprinted thereon, said body having lines of weakness at the interface between each end portion and the central portion, the indicia on the central portion indicates the contents of the pipe, conduit and the like with which the marker is used and the indicia on the removable end portions are flow direction indicators in the form of arrows, said central portion and said end portion each define integral, lanced offset strap portions for receiving an attachment strap.

2. A marker as defined by claim 1 wherein said central portion defines slots therein adapted to receive a strap.

3. A marker as defined by claim 2 wherein each of said end portions include slots therein adapted to receive a strap.

4. A marker as defined by claim 3 wherein said body defines a transversely extending groove at the interface between each end portion and the central portion to thereby define said lines of weakness and a frangible connection between the end portion and the central portion.

5. A marker as defined by claim 1 wherein said body is color coded to indicate the nature of the contents of the pipe, conduit and the like with which the marker is used.

6. A marker as defined by claim 1 wherein said body defines a transversely extending groove at the interface between each end portion and the central portion to thereby define said lines of weakness and a frangible connection between the end portions and the central portion.

7. A marker as defined by claim 6 further including a flexible attachment strap extending through the offset strap portion of the central portion for attaching the body to the pipe, conduit and the like with which the marker is used.

8. A pipe contents and flow direction identification device attachable to a pipe for indicating the contents of the pipe and flow direction of the pipe contents, said device comprising:

an elongated generally rectangular contents marker fabricated from a rigid material, said marker having indicia imprinted thereon indicating the pipe contents;

a flow direction marker integral with an frangibly joined to the contents marker at a longitudinal end thereof whereby the flow direction marker may be separated from the contents marker prior to attachment to a pipe;

means engaging the contents marker for attaching the contents marker to a pipe comprising at least one strap;

another flow direction marker integral with and frangibly connected to the contents marker at a longitudinal end thereof opposite said a flow direction marker, said a flow direction marker including means for indicating flow direction and said another flow direction marker including means for indicating flow in a direction opposite to the flow direction indicated by said a flow direction marker, said means for indicating flow direction for each of said flow direction markers comprising an arrow imprinted on the flow direction marker, said flow direction markers joined to said contents marker by lines of weakness each of said flow direction markers are joined to said contents marker by an elongated groove stamped into the material defining said flow direction markers and said contents marker, said grooves defining said lines of weakness, each of said flow direction markers and said contents marker define integral, lanced offset strap portions for receiving said strap attaching means; and means for attaching one of said flow direction markers to a pipe after the same has been separated from said contents marker.

9. A pipe contents and flow direction identification device as defined by claim 8 wherein said flow direction markers and said contents marker are color coded to indicate the nature of the pipe contents.

10. A pipe contents and flow direction identification device as defined by claim 9 wherein said flow direction markers and said contents marker define integral, lanced offset strap portions for receiving said attaching means.

* * * * *

UNITED STATES PATENT AND TRADEMARK OFFICE

CERTIFICATE OF CORRECTION

PATENT NO. : 4,246,712

DATED : January 27, 1981

INVENTOR(S) : James A. Vander Wall

It is certified that error appears in the above—identified patent and that said Letters Patent is hereby corrected as shown below:

Column 1, line 21:

"ANSI" should be --ANSI A--;

Column 3, line 47:

"15" should be --5--;

Column 4, line 47:

" improvment" should be --improvement--;

Column 4, line 49:

"emplying" should be --employing--;

Column 5, line 11:

"Pacing" should be --Packing--.

Signed and Sealed this

*Twenty-first* Day of *July 1981*

[SEAL]

*Attest:*

GERALD J. MOSSINGHOFF

*Attesting Officer*

*Commissioner of Patents and Trademarks*